US006394829B1

(12) United States Patent
Patterson et al.

(10) Patent No.: US 6,394,829 B1
(45) Date of Patent: May 28, 2002

(54) SELF-ALIGNING ELECTRICAL INTERCONNECT

(75) Inventors: Jon M. Patterson, Mokena; Louis M. Spoto, Sleepy Hollow; Tao-Ming Wang, Long Grove, all of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/495,998

(22) Filed: Feb. 1, 2000

(51) Int. Cl.[7] ..... H01R 13/64
(52) U.S. Cl. ..... 439/252
(58) Field of Search ..... 439/249, 252, 439/246, 382, 748, 276

(56) References Cited

U.S. PATENT DOCUMENTS

| | | | | |
|---|---|---|---|---|
| 1,735,731 A | * | 11/1929 | Cunningham | 439/252 |
| 2,255,553 A | | 9/1941 | Funk | |
| 3,083,345 A | * | 3/1963 | Scheller | 439/677 |
| 3,221,293 A | | 11/1965 | Regan | |
| 3,617,992 A | | 11/1971 | Ruehlemann | |
| 3,805,116 A | | 4/1974 | Nehmann | |
| 4,310,210 A | | 1/1982 | Takahashi et al. | |
| 4,558,912 A | * | 12/1985 | Coller et al. | 439/246 |
| 5,000,695 A | * | 3/1991 | Nishiyama et al. | 439/276 |
| 5,122,083 A | | 6/1992 | Watanabe et al. | |
| 5,310,353 A | | 5/1994 | Parrish et al. | |
| 5,383,800 A | | 1/1995 | Saka et al. | |
| 5,649,837 A | | 7/1997 | Arnold | |
| 5,857,877 A | | 1/1999 | Hotea et al. | |
| 5,980,309 A | | 11/1999 | Saka | |

* cited by examiner

*Primary Examiner*—Brian Sircus
*Assistant Examiner*—Phuong Dinh
(74) *Attorney, Agent, or Firm*—Paul F. Donovan

(57) ABSTRACT

A molded electrical interconnect having an electrical conductor embedded therein, a conductive terminal disposed in the cavity, a first end portion of the terminal disposed toward an open end of the cavity and a second end portion thereof coupled to a portion of the electrical conductor protruding into the cavity, the terminal is pivotally supported by a fulcrum near the second end portion thereof so that the first end portion of the terminal is movable in the cavity for alignment with a mating terminal.

15 Claims, 2 Drawing Sheets

SELF-ALIGNING ELECTRICAL INTERCONNECT

BACKGROUND OF THE INVENTION

The invention relates generally to electrical connectors, and more particularly to molded electrical interconnects having self-aligning terminals.

It is known in some applications to replace bundles of electrical wires having crimped connectors with molded plastic interconnects having electrical conductors with female terminals embedded therein, for example by insert molding processes. In the automotive and other industries bundled electrical wires having crimped connectors account for a significant number of warranty claims, often for failure to make proper electrical connections.

The plastic portion of the interconnect provides insulation for the conductors and terminals embedded therein and also provides rigidity to the interconnect in comparison to wire bundles, which are relatively flexible. Upon installation of the molded interconnect, the female terminals thereof mate with corresponding male electrical terminals for example electrical terminals on vehicle transmission solenoids.

Although the rigid shape of prior art molded plastic interconnects facilitates proper orientation thereof during assembly, unlike wire bundles, the rigidity of the interconnect provides only minimal tolerance for any misalignment between the insert molded terminals thereof and the intended mating terminal. Misalignment between the terminals during assembly may thus result in damage thereto, particularly where the interconnect is installed with substantial force, as occurs in the exemplary automotive solenoid application.

The female electrical terminals of prior art molded plastic interconnects are known as M-slots, and are formed by stamping end portions of the conductors. To provide proper spring resiliency of the female terminal, however, the conductor material from which the M-slot is formed must comprise relatively sophisticated and costly metal alloys.

Also, due to limitations imposed by insert molding technology, modification of the male terminals of the application devices, for example the transmission solenoids, is sometimes required to mate with female terminals embedded in prior art molded plastic interconnects.

An object of the invention is to provide novel molded electrical interconnects, self-aligning terminals therefor, and combinations thereof that improve upon the prior art.

Another object of the invention is to provide novel molded electrical interconnects, self-aligning terminals therefor, and combinations thereof that are economical and reliable.

A further object of the invention is to provide novel molded electrical interconnects having embedded conductors formed of relatively cost effective conductive materials, which are not necessarily the same as the materials of the electrical terminal connected thereto.

Yet another object of the invention is to provide novel molded electrical interconnects that may be manufactured using insert molding technology.

Still another object of the invention is to provide novel molded electrical interconnects, self-aligning terminals therefor, and combinations thereof that mate with existing terminals of electrical devices, for example transmission solenoid terminals, without modification of the electrical device terminal or other portions of the electrical device.

A more particular object of the invention is to provide novel self-aligning electrical connectors comprising a conductive terminal disposed in a housing cavity, the terminal having resilient members protruding from corresponding side portions thereof, whereby the resilient members are flexible against corresponding side wall portions of the cavity to permit movement of the terminal therein.

Another more particular object of the invention is to provide novel self-aligning electrical connectors comprising a conductive terminal disposed in a housing cavity having a fulcrum therein, the terminal having a first end portion disposed toward an open end of the cavity, the terminal pivotally supported by the fulcrum, whereby the terminal is pivotal in the cavity to permit alignment of the first end portion thereof.

Yet another more particular object of the invention is to provide novel molded electrical interconnects comprising a cavity having a fulcrum therein, an electrical conductor embedded in the interconnect, a conductive terminal disposed in the cavity the terminal having a first end portion disposed toward an open end of the cavity and a second end portion coupled to a portion of the electrical conductor protruding into the cavity, whereby the terminal is pivotally supported by the fulcrum.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
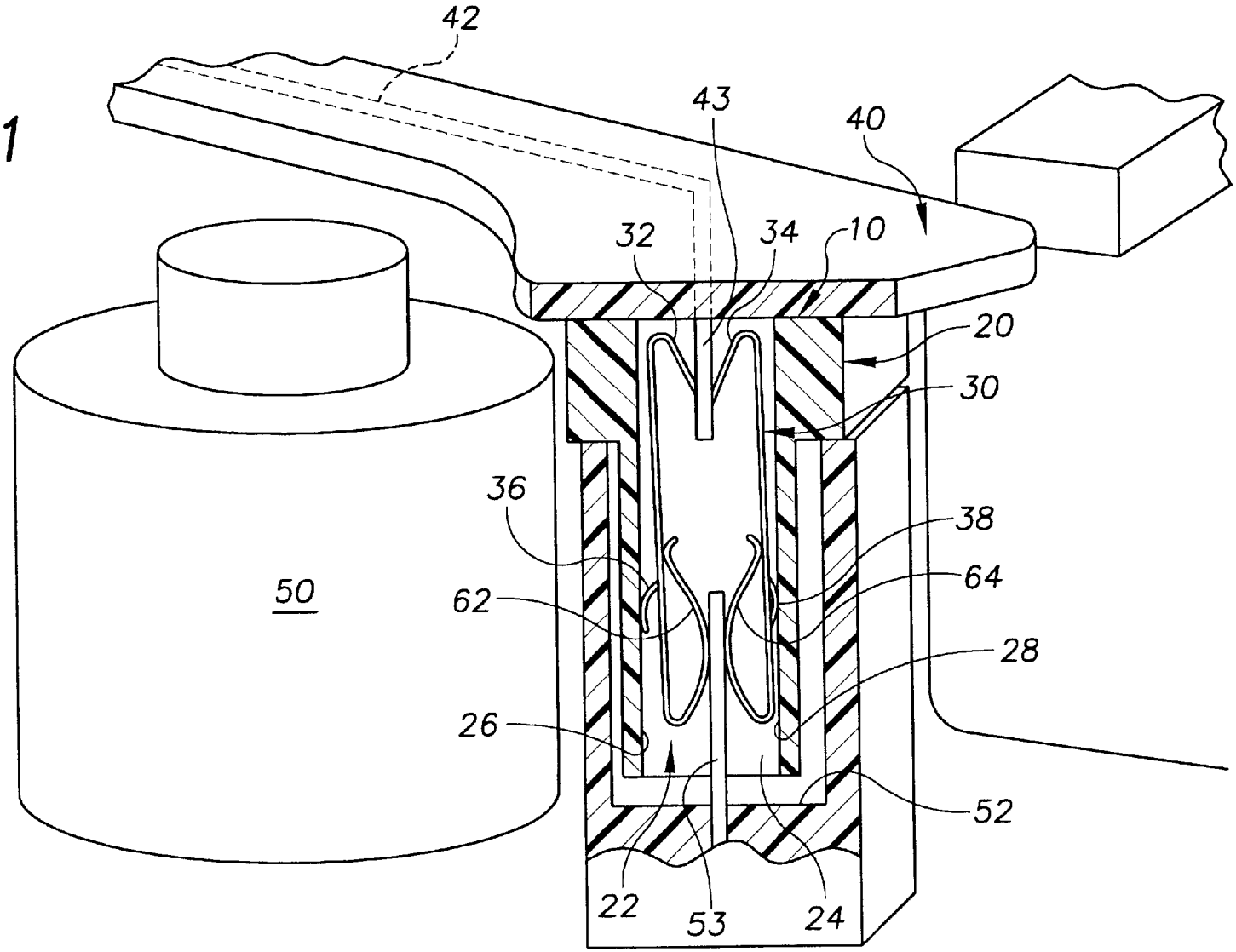
FIG. 1 is partial sectional view of a portion of a molded electrical interconnect having an exemplary self-aligning terminal coupled to an electrical device terminal.

FIG. 1 illustrates a self-aligning electrical connector 10 comprising a housing 20 having a cavity 22, and a conductive terminal 30 disposed therein, as discussed below.

In the exemplary embodiment the housing 20 is an integral part of an insulating interconnect 40 having an electrical conductor 42 embedded therein. A portion 43 of the conductor 42, in the exemplary form of a male blade terminal, protrudes into the housing cavity 22 for electrically coupling to the terminal 30, as discussed further below.

In one embodiment, the interconnect has a plurality of housings or cavities for accommodating one or more corresponding terminals and a plurality of electrical conductors embedded therein for electrically coupling with the terminals. In the exemplary embodiment, the interconnect and housing form a rigid, unitary molded plastic member and the conductors are relatively inexpensive copper alloy conductors embedded therein by insert molding.

In FIG. 1, the terminal comprises first and second converging spring contacts 32 and 34 that mechanically and electrically connect to the electrical conductor portion 43 protruding into the cavity. The exemplary spring contacts are flexible away from each other to permit insertion of the conductor therebetween, and then corresponding ends of the spring contacts engage and retain the conductor to prevent withdrawal of the terminal from the housing cavity. In other embodiments, however, the terminal may be retained in the housing cavity by structure other than the portion thereof making electrical contact with the conductor.

The exemplary housing 20 in FIG. 1 is disposed into a mating housing cavity 52 having an electrical conductor 53 protruding therein. The conductor 53 may be connected to or otherwise associated with an electrical device 50, for example a transmission solenoid, to which it is desirable to electrically connect the conductor 42 of the interconnect 40.

The conductor 42 is electrically connected to the conductor 53 by the terminal 30. The terminal 30 is generally movable within the cavity 22 to permit electrical coupling with the conductor 53 while accommodating any misalignment therebetween.

In other embodiments, the housing 20 is a stand alone insulating member without the rigid interconnect portion having the conductors 42 embedded therein. The conductor 42 may for example be an electrical wire having a portion protruding into the housing cavity 22 thereof for electrical coupling with the terminal 30 disposed therein.

According to one aspect of the invention, the conducting terminal comprises resilient members protruding from corresponding side portions thereof, wherein the resilient members arc flexible against corresponding side wall portions of the cavity to permit movement of the terminal therein, whereby a first end portion of the terminal disposed toward the cavity opening may be aligned with and coupled to a mating electrical connector.

Figure 2:
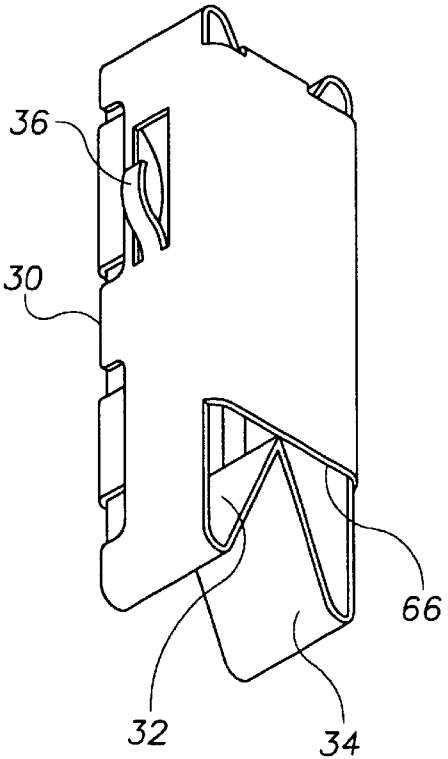
FIG. 2 is a perspective view of an exemplary self-aligning electrical terminal.

In the exemplary embodiment of FIG. 1, the terminal 30 comprises a first resilient member 36 protruding from a first side portion of the terminal and a second resilient member 38 protruding from an opposite second side portion thereof. The first and second resilient members are flexible against corresponding side wall portions 26 and 28 of the cavity 22 to permit movement of the terminal therein, particularly the end portion of terminal disposed toward the open end 24 of the cavity. FIG. 2 also illustrates one of the resilient members 36 protruding from the exemplary terminal 30.

In other embodiments, the terminal and the resilient members thereof may comprise alternative forms, for example the sectional shape of the terminal may be other than square or rectangular. The terminal may also comprise additional resilient members protruding from other side portions thereof, whereby the resilient members are flexible against corresponding cavity side wall portions to permit movement of the terminal therein.

The first end portion of the terminal 30, opposite the second end portion thereof coupled to the electrical conductor 43, is disposed toward and accessible from the open end 24 of the cavity 22, and comprises an electrical connector configuration thereon which is electrically connectable to the mating conductor 53.

In the exemplary embodiment, the first end portion of the terminal 30 comprises converging spring contacts 62 and 64 that converge toward each other and then diverge away from each other, thereby providing a female electrical receptacle that is releasably connectable with the mating terminal 53 disposed therebetween, as in FIG. 1. In other embodiments, the electrical connector on the first end portion of the terminal may have some other configuration.

According to another aspect of the invention, the housing 20 includes a fulcrum disposed therein on which the terminal 30 is pivotally supported, preferably proximate the second end portion thereof, whereby the first end portion of the terminal having the electrical connector configuration is movable in the housing as the terminal pivots about the fulcrum.

Figure 4:
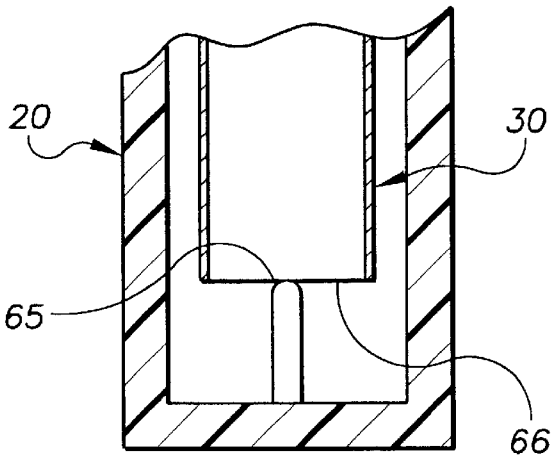
FIG. 4 is a partial section view of a portion of a molded electrical interconnect and an exemplary self-aligning terminal.
Figure 3:
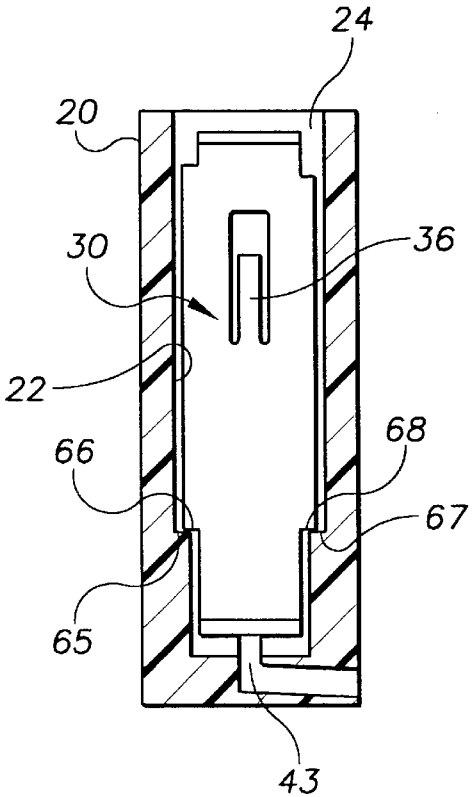
FIG. 3 is another partial sectional view of a portion of a molded electrical interconnect having an exemplary self-aligning electrical terminal.

In the exemplary embodiment, illustrated best in FIG. 3, the fulcrum comprises first and second pivot members 65 and 67 spaced apart in the housing cavity 22. The exemplary terminal 30 comprises first and second support portions 66 and 68 each of which is pivotally disposed on a corresponding one of the first and second pivot members 65 and 67. FIG. 4 illustrates the support portion 66 of the terminal 30 supported by the pivot member 65.

FIG. 2 illustrates one of the support portions 66 on the terminal 30, which is a portion of a side wall thereof. Alternatively, the support portions of the terminal and the pivot members of the housing may assume other forms.

In the preferred embodiment, the terminal comprising the resilient members on the side portions thereof is pivotally supported on the fulcrum of the housing cavity, although either feature may be employed separately. The resilient members are disposed generally between the open end of the cavity and the fulcrum and support portions of the terminal.

In the exemplary embodiment, the first and second support portions 66 and 68 of the terminal 30 are located farther from the open end 24 of the cavity than the resilient members, for example the resilient member 36 in FIG. 3. The first and second support portions 66 and 68 are disposed on substantially opposite sides of the terminal 30, substantially transversely to the opposite first and second resilient members 36 and 38 thereof, whereby the resilient members 36 and 38 are flexible against the cavity side wall portions as the terminal pivots about the support portions 66 and 68 supported on the fulcrum.

The terminal 30 generally comprises a conductive material, for example beryllium copper. In the exemplary embodiment, the terminal, including the resilient members, support portions and electrical connector configurations on the end portions thereof are formed as a unitary member, for example in a stamping operation.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A self-aligning electrical connector comprising:

a housing having a cavity with an open end and a side wall;

a conductive terminal having a side portion, resilient members protruding from corresponding portions of the side of the terminal, the terminal disposed in the housing cavity, the terminal pivotally and freely supported by a fulcrum in the housing cavity, whereby the resilient members of the terminal are flexible against corresponding portions of the cavity side wall to permit pivotal movement of the terminal therein.

2. The connector of claim 1, the terminal has a first end portion disposed toward and accessible from the open end of the cavity, whereby the first end portion of the terminal is movable in the housing cavity as the terminal pivots about the pivot members.

3. The connector of claim 2, the terminal has a second end portion opposite the first end portion, the second end portion of the terminal is coupled to an electrical conductor in the housing cavity.

4. The connector of claim 1, the terminal has a first end portion disposed toward the open end of the cavity and an opposite second end portion, the housing is part of a rigid plastic interconnect having an electrical conductor embedded therein, a portion of the electrical conductor protruding into the housing cavity and coupled to the second end portion of the terminal.

5. The connector of claim 1, the terminal has a first end portion disposed toward the open end of the cavity and an opposited second end portion, the first and second end portions of the terminal comprise converging spring contacts.

6. A self-aligning electrical connector comprising:

a housing having a cavity with an open end and a fulcrum disposed therein;

a conductive terminal disposed in the cavity, the terminal having a first end portion disposed toward the open end of the cavity, the terminal having a second end portion opposite the first end portion thereof with converging spring contacts, the terminal pivotally supported by the fulcrum, whereby the terminal is pivotal in the cavity about an axis that is substantially intermediate the first and second end portions thereof to permit alignment of the terminal.

7. The connector of claim 6, resilient members protruding from corresponding side portions of the terminal, the resilient members located between the fulcrum and the open end of the cavity and flexible against side walls of the cavity.

8. The connector of claim 6, the housing is part of a rigid plastic interconnect having an electrical conductor embedded therein, a portion of the electrical conductor protruding into the housing cavity and coupled to a second end portion of the terminal.

9. The connector of claim 6, first and second support portions disposed on substantially opposite sides of the terminal, first and second resilient members disposed on substantially opposite sides of the terminal and substantially transverse to the first and second support portions thereof, the first and second support portions of the terminal are disposed on the fulcrum.

10. An electrical interconnect comprising:

a rigid plastic member having a cavity with side walls and an open end;

a fulcrum disposed in the cavity;

an electrical conductor embedded in the plastic member, the electrical conductor having a portion protruding into the cavity;

a conductive terminal disposed in the cavity, the terminal having a first end portion disposed toward the open end of the cavity, the terminal having a second end portion slidably coupled to the portion of the electrical conductor protruding into the cavity, the electrical conductor and conductive terminal are discrete elements, the second end portion of the terminal pivotally supported by the fulcrum.

11. The connector of claim 10, the terminal has first and second support portions pivotally disposed on the fulcrum in the cavity.

12. The connector of claim 11, first and second resilient members protruding from corresponding side portions of the terminal, the resilient members disposed between the fulcrum and the open end of the cavity.

13. The connector of claim 12, the first and second support portions disposed on substantially opposite sides of the terminal, the first and second resilient members disposed on substantially opposite sides of the terminal and substantially transverse to the first and second support portions thereof, the fulcrum comprises first and second pivot members that pivotally support the first and second support portions of the terminal.

14. The connector of claim 13, the first end portion of the terminal comprises two spring contacts that first converge toward and then diverge away from each other.

15. The connector of claim 11, the second end portion of the terminal comprises converging spring contacts having end portions that engage and retain the portion of the electrical conductor protruding into the cavity.

* * * * *